United States Patent [19]

Kobayashi et al.

[11] 4,111,823

[45] Sep. 5, 1978

[54] DRY DEVELOPING POWDER INCLUDING TONER POWDERS OF DIFFERENT PARTICLE SIZE

[75] Inventors: Kazuo Kobayashi; Akira Suzuki; Motoharu Tanaka; Norihiko Inaba; Hisao Yuyama, all of Tokyo, Japan

[73] Assignee: Ricoh Co., Ltd., Tokyo, Japan

[21] Appl. No.: 798,995

[22] Filed: May 20, 1977

[30] Foreign Application Priority Data

May 28, 1976 [JP] Japan ..... 51-61965

[51] Int. Cl.[2] ..... G03G 9/14; G03G 9/08

[52] U.S. Cl. ..... 252/62.1 P; 427/18; 252/62.53; 252/62.54; 428/403; 428/407

[58] Field of Search ..... 252/62.1 P, 62.1 R, 252/62.53, 62.54; 427/18, 22; 96/1.5 SD

[56] References Cited

U.S. PATENT DOCUMENTS

| | | | |
|---|---|---|---|
| 3,060,051 | 10/1962 | Johnson et al. | 252/62.1 P |
| 3,287,150 | 11/1966 | Lehmann | 96/1.5 SD |
| 3,349,703 | 10/1967 | Varron et al. | 252/62.1 P |
| 3,627,682 | 12/1971 | Hall et al. | 252/62.1 P |
| 3,698,005 | 10/1972 | Nacci et al. | 427/18 |
| 3,895,125 | 7/1975 | Tsuchiya et al. | 427/18 |

*Primary Examiner*—John T. Goolkasian

*Attorney, Agent, or Firm*—Blanchard, Flynn, Thiel, Boutell & Tanis

[57] ABSTRACT

The present invention provides a dry developing powder prepared by mixing (A) a magnetic powder having a mean grain size of 10–30μ and which consists essentially of wax or thermoplastic resin and pulverized magnetic substance, with (B) a powder having a mean grain size of 5–20μ and which consists essentially of thermoplastic resin. The powder (B) may also contain pulverized magnetic substance in an amount less than that of powder (A). Powder (B) may also contain a dye as polarity-controlling agent. Fillers such as calcium carbonate, magnesium oxide talc and magnesium silicate may be incorporated into either powder to control bridging phenomena. Use of these developing powder facilitates pressure fixing as well as thermal fixing, and particularly provides an image having excellent continuous gradation.

12 Claims, 1 Drawing Figure

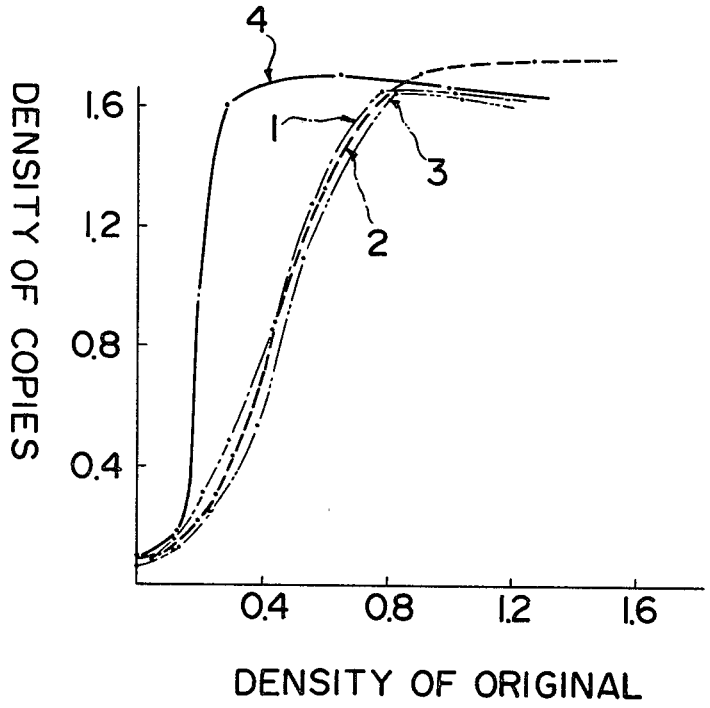
4
1
2
3
1.6
1.2
0.8
0.4
DENSITY OF COPIES
0.4
0.8
1.2
1.6
DENSITY OF ORIGINAL

DRY DEVELOPING POWDER INCLUDING TONER POWDERS OF DIFFERENT PARTICLE SIZE

BACKGROUND OF THE INVENTION (a) Field of the Invention

The present invention relates to a dry developing powder. To be precise, it relates to a dry developing powder which is useful for electrophotography, electrostatic printing process, electrostatic recording process, magnetic printing process, etc. and facilitates pressure fixing and/or thermal fixing.

(b) Description of the Prior Art

As one of the fixing methods suitable for electrophotography, electrostatic printing process, electrostatic recording process, magnetic printing process, etc., there is known the so-called "pressure fixing method" in which a recording material carrying a developing powder in the shape of the image is introduced between a pair of pressure-applying rollers. This fixing method is said to be advantageous in that it can be instantly practiced by switching on the power source of the apparatus concerned, it is free of such troubles as environmental pollution, and it can perform the fixing practically completely on the occasion of continuous operation at high speed.

As to the dry developing powder (which hereinafter may be occasionally called "the developer" for short) for use in this pressure-fixing method, there has been proposed, for instance, a microcapsule toner in Japanese Patent Open Nos. 71648/1973 and 75032/1973. However, this developing powder is still unsatisfactory inasmuch as the coating resin therefor is restricted by both the tendency to electrification by friction with the carrier particles (i.e., triboelectric tendency) and the manufacturing technique.

There has also been proposed in Japanese Patent Open No. 50042/1975 a developing powder consisting essentially of resin, wax ingredient, pulverized magnetic substance and conductive particles. However, this developing powder, like the thermal-fixing developer described in the specification for U.S. Pat. No. 3,639,245, is one prepared by sticking conductive particles to the resin constituting the matrix of the powder by way of only the surface portion of said matrix. A developer of such a composition has drawbacks such that in the case where it is employed in forming an image, although the fixing property thereof is satisfactory, the fluidity of the developing powder is insufficient and the preservability thereof is poor. Besides, such a developing powder tends to be attended with phase separation of the wax ingredient and the thermoplastic resin at the time of manufacturing, which hampers easy manufacture thereof.

On the other hand, in the case of the thermal-fixing method wherein the fixing is effected by melting a portion of the binding agent by applying heat, there has not yet been developed such a developer that can be manufactured with ease and that displays an excellent continuous gradation of image.

SUMMARY OF THE INVENTION

A principal object of the present invention is to provide a dry developing powder which is excellent in thermal-fixing property in addition to pressure-fixing property and can produce a highly concentrated image with gradient. Another object of the present invention is to provide a dry developing powder which is useful for a high-speed copying apparatus or printing apparatus and which can be used with safety. A further object of the present invention is to provide a dry developing powder which can be manufactured easily and economically, and which demonstrates a satisfactory preservability.

To be precise, the present invention provides a dry developing powder comprising (A) a magnetic powder having a mean grain size of 10–30$\mu$ which consists essentially of 20–80 parts by weight of a wax or thermoplastic resin having a melting point of about 35°–160° C. and 80–20 parts by weight of a pulverized magnetic substance and (B) a powder having a mean grain size of 5–20$\mu$ which consists essentially of thermoplastic resin, wherein said magnetic powder having a mean grain size of 10–30$\mu$ is mixed with said powder having a mean grain size of 5–20$\mu$ at the rate of 70–98% by weight of the former to 30–2% by weight of the latter.

BRIEF DESCRIPTION OF THE DRAWING

The appended drawing is a graph illustrating the relation between the concentration of an original image and the concentration of a copied image thereof on the occasion of performing the copying by the use of a developing powder according to the present invention and a comparative developing powder, and curves 1, 2 and 3 represent examples embodying the present invention, respectively, while curve 4 represents the comparative example.

DETAILED DESCRIPTION OF THE INVENTION

Hereunder will be given further particulars of the present invention. In this context, for the convenience' sake, the afore described magnetic powder having a mean grain size of 10–30$\mu$ is referred to as "toner-A" and the powder having a mean grain size of 5–20$\mu$ is referred to as "toner-B".

As regards the wax ingredient (which acts as the binder) useful as toner-A in the present invention, it is desirable to have a melting point in the range of about 35°–160° C. in order to impart a satisfactory fixing property to the developing powder.

To give examples of the applicable wax, there are natural or synthetic aliphatic wax such as paraffin wax, crystalline wax, carnauba wax, montan wax, ceresin wax and sugar cane wax; fatty acid such as stearic acid, palmitic acid and behenic acid; metallic salt of fatty acid such as lithium stearate, aluminum stearate, barium stearate and zinc palmitate; amide hydroxyl wax such as N-($\beta$-hydroxyethyl)-ricinolamide, N,N'-ethylene-bis-ricinolamide and N,N'-ethylene-bis-1,2-hydroxystearyl amide; ethylene homopolymer; dicyclohexyl phthalate; diphenyl phthalate; hydroxystearic acid; ethylene glycol monohydroxystearate; etc.

These wax ingredients may be used by combining two or more of them. In the case where these waxes are employed for toner-A, it is especially profitable to apply the developer of the present invention to the pressure fixing method.

Further, as a substitute for the foregoing wax ingredients, a thermoplastic resin may be used as the binder. As the thermoplastic resin meeting the requirement of a melting point ranging from 35° to 160° C., there can be cited petroleum resin, xylene resin, phenol resin, maleic resin, styrene resin, rosin resin, phenol formaldehyde resin, alkyd resin, ketone resin, acrylic resin, vinyl resin, cellulose resin and so forth, and these resins may be used either independently or by combining two or more of them.

In the case where these thermoplastic resins are employed for toner-A, it is especially profitable to apply the developer of the present invention to the thermal-fixing method.

Further, as the applicable pulverized magnetic substance to constitute toner-A together with these waxes or thermoplastic resins, there can be cited iron powder, tri-iron tetroxide powder, ferric oxide powder, chromium powder, chromium dioxide powder, nickel powder, etc. The appropriate mean grain size of these magnetic substances is in the range of about 0.1–2.5μ.

Toner-A is prepared by employing the foregoing wax ingredient or thermoplastic resin and pulverized magnetic substance as essential constituents thereof, and the appropriate ratio of these two constituents is 20–80 parts by weight of the former to 80–20 parts by weight of the latter. Inasmuch as this toner-A is supposed to function as a carrier too, in the case where it has a mean grain size of less than 10μ, its effect as a carrier would become poor, while in the case where it has a mean grain size of more than 30μ, it would cause an uneven or rough resulting image, or hamper the appearance of a satisfactory half-tone.

In the case where the ratio of the wax ingredient or thermoplastic resin to the pulverized magnetic substance is beyond the aforesaid scope, toner-A per se tends to become fragile and/or difficult to fix. Further, the composition of this toner-A may comprise some appropriate filler, coloring agent such as carbon black, etc. as occasion demands, in addition to said wax or thermoplastic resin and pulverized magnetic substance.

As the filler applicable herein, there can be cited calcium carbonate, magnesium oxide, talc, magnesium silicate, calcium silicate, etc. Although these fillers may be applied either independently or by combining two or more of them, the use of magnesium carbonate and calcium carbonate is particularly desirable. The appropriate amount of the filler to be applied is in the range of 2–20 parts by weight relative to 100 parts by weight of the total amount of said wax or thermoplastic resin and pulverized magnetic substance, and admixing of the filler as above will have the effect of further controlling the bridging phenomenon.

As the coloring agent applicable herein, the conventional pigments or dyes prevalent in this art are useful, and to give examples of apposite substances, in addition to the afore-mentioned carbon black, there are such pigments as Aniline Black, channel black, acetylene black and lamp black and such dyes as Victoria Blue, Farnel Blue, Permanent Blue toner and Nigrosine Base. The appropriate amount of the coloring agent to be applied is in the range of 2–10 parts by weight relative to 100 parts by weight of the total amount of said wax or thermoplastic resin and pulverized magnetic substance, and admixing of the coloring agent as above will have the effect of further enhancing the image concentration.

On the other hand, toner-B to be mixed with toner-A having the above described composition consists essentially of thermoplastic resin, and as the thermoplastic resin herein, any of the thermoplastic resins exemplified with respect to toner-A is useful.

This toner-B may comprise a pigment or dye to the extent of 2–20 parts by weight relative to 100 parts by weight of said thermoplastic resin. The pigments and dyes useful as coloring agent herein are the same as those described with respect to the foregoing toner-A, and admixing of this coloring agent has the effect of further enhancing the image concentration.

In the case where toner-B either consists of thermoplastic resin or consists of thermoplastic resin and coloring agent (to wit, toner-B is non-magnetic), said toner-B is supposed to be electrified through friction with toner-A. Therefore, in order to intensify the triboelectricity on this occasion, it is desirable to apply a polarity-controlling agent additionally.

As the polarity-controlling agent to be added to toner-B for this purpose, there can be cited such dyes as Fettschwarze-HBN, Nigrosine, Brilliant Spirit Schwarze and Shaddock Schwarze X, and such metallic dyes as Phthalocyanine Blue. An ideal amount of this polarity-controlling agent to be applied is in the range of 0.1–10 parts by weight relative to 100 parts by weight of said thermoplastic resin.

Further, a magnetic toner-B is composed of 60–90 parts by weight of thermoplastic resin and 40–10 parts by weight of pulverized magnetic substance. As the pulverized magnetic substance to constitute this magnetic toner-B, those substances exemplified with respect to toner-A can be applied as they are. However, heed must be given to the fact that, in the case of toner-B comprising this pulverized magnetic substance (having a mean grain size of 0.1–2.5μ), when the content of the pulverized magnetic substance is equal to the content of pulverized magnetic substance for toner-A, the resulting copy will become inferior in reproducibility of half-tone. Therefore, it is necessary to prescribe that the content of pulverized magnetic substance in magnetic toner-B is less than the content of pulverized magnetic substance in toner-A. For this magnetic toner-B there may be adopted a means of further enhancing the image concentration by adding thereto such a coloring agent as described above to the extent of 2–10 parts by weight relative to 100 parts by weight of the total amount of thermoplastic resin and pulverized magnetic substance, and further such a filler as described above may be added thereto to the extent of 2–20 parts by weight relative to 100 parts by weight of said total amount.

This magnetic toner-B is also supposed to be electrified through friction with toner-A. Therefore, in order to intensify this triboelectrification, it is advisable to apply such a polarity-controlling agent as described above to the extent of 0.1–10 parts by weight relative to 100 parts by weight of the total amount of thermoplastic resin and pulverized magnetic substance.

As elucidated in the foregoing, a developer according to the present invention consists of a mixture of toner-A and toner-B (this toner-B includes one comprising pulverized magnetic substance or one not comprising pulverized magnetic substance), and the mixing ratio of said toners is 70–98 wt. % of the former to 30–2 wt. % of the latter. And, the grain size of toner-A is preferably larger than that of toner-B.

In order to manufacture such a developing powder as above according to the present invention, it will do to follow such a procedure as exemplified in the following:

(a) An appropriate wax or thermoplastic resin and a pulverized magnetic substance, with the addition of additives (such as coloring agent, filler, etc.) as occasion demands, are kneaded while applying heat and then the kneaded mixture is crushed so as to attain a mean grain size of 10–30μ, thereby preparing toner-A; meanwhile, (b) an appropriate thermoplastic resin, with the addition of additives (such as coloring agent, polarity-controlling agent, filler, etc.) as occasion demands, is melted or kneaded while applying heat and then is crushed so as to attain a mean grain size of 5–20μ, thereby preparing non-magnetic toner-B; or an appropriate thermoplastic resin and pulverized magnetic substance, with the addition of additives (such as coloring agent, polarity-controlling agent, filler, etc.) as occasion demands, are kneaded while applying heat and then the kneaded mixture is crushed so as to attain a mean grain size of 5–20μ, thereby preparing magnetic toner-B; and subsequently, (c) the resulting toner-A and toner-B are mixed together at the rate of 70–98 wt. % of the former to 30–2 wt. % of the latter.

The dry developing powder according to the present invention manufactured in this way is of excellent quality sufficient for realizing the expected effects. Especially, the use of a developing powder consisting of magnetic toner-B comprising pulverized magnetic substance and toner-A renders it possible to obtain a clear-cut image free of fog without resorting to bias. In this connection, the above description centers on the case of the pressure fixing, but the developing powder under the present invention proves to have the same effect as in the pressure fixing when applied to the thermal fixing.

DESCRIPTION OF THE PREFERRED EMBODIMENTS

Hereunder will be given some examples embodying the present invention. In this context, the term "part" signifies "part by weight".

Example 1

80 parts of polyethylene wax, 20 parts of calcium stearate, 100 parts of iron powder and 10 parts of carbon black were uniformly mixed together, and the resulting mixture was kneaded at a temperature of 130°–135° C. and crushed thereafter, whereby a magnetic powder (to wit, toner-A) having a mean grain size of 20μ was obtained. In order to impart a free fluidity to this toner-A, carbon black was admixed with toner-A at the rate of 1 part of the former to 99 parts of the latter.

Meanwhile, 100 parts of polyamide resin and 6 parts of carbon black were uniformly mixed together, and the resulting mixture was kneaded at a temperature of 140°–145° C. and crushed thereafter, whereby a non-magnetic powder (to wit, non-magnetic toner-B) having a mean grain size of 10μ was obtained. Subsequently, 95 parts of said toner-A (which was admixed with carbon black for the purpose of imparting a free fluidity) and 5 parts of said non-magnetic toner-B were thoroughly mixed together, whereby a dry developer was prepared.

When copying was performed by employing this developer while applying −500 V bias by the use of a commercial electrophotographic copying machine (namely, Model PT-510, a product of K. K. RICOH), there was obtained a continuity of images displaying a satisfactory half-tone (cf. curve-1 of the drawing). This fixed image was free from coming off even when rubbed with a finger.

For the purpose of comparison, a developer was prepared through the same procedure as above, save for omitting non-magnetic toner-B. When this comparative developer was tested in the same way as above, there was obtained a copy with no half-tone such as indicated by curve-4 in the drawing.

Example 2

50 Parts of polyethylene resin, 50 parts of iron powder and 3 parts of carbon black were uniformly mixed together, and the resulting mixture was kneaded at a temperature of about 125° C. and crushed thereafter, whereby a magnetic powder (to wit, toner-A) having a mean grain size of about 20μ was obtained. In order to impart a free fluidity to this toner-A, carbon black was admixed with toner-A at the rate of 1 part of the former to 99 parts of the latter.

Meanwhile, 80 parts of acrylic resin, 20 parts of iron powder and 5 parts of carbon black were uniformly mixed together, and the resulting mixture was kneaded at a temperature of about 140° C. and crushed thereafter, whereby a magnetic powder (to wit, magnetic toner-B) having a mean grain size of about 14μ was obtained.

Subsequently, 90 parts of said toner-A (which was admixed with carbon black for the purpose of imparting a free fluidity) and 10 parts of said magnetic toner-B were thoroughly mixed together, whereby a dry developer was prepared.

When copying was performed by employing this developer without applying bias by the use of a commercial electrophotographic copying machine (namely, Model NT-630, a product of K. K. RICOH), there was obtained a continuity of fog-free images displaying a satisfactory half-tone (cf. curve-2 of the drawing). This fixed image was free from coming off even when rubbed with a finger.

Example 3

50 Parts of polyethylene wax, 50 parts of iron powder and 1 part of carbon black were uniformly mixed together, and the resulting mixture was kneaded at a temperature of about 140° C., cooled thereafter and crushed, whereby a magnetic powder (to wit, toner-A) having a mean grain size of about 21μ was obtained.

Meanwhile, 80 parts of polyamide resin, 30 parts of iron powder and 3 parts of carbon black were uniformly mixed together, and the resulting mixture was kneaded at a temperature of about 130° C., cooled thereafter and crushed, whereby a magnetic powder (to wit, magnetic toner-B) having a mean grain size of about 12μ was obtained.

Subsequently, 85 parts of said toner-A and 15 parts of said toner-B were thoroughly mixed together, whereby a dry-developer was prepared.

When copying was performed by employing this developer without applying bias by the use of the same copying machine used in Example 1, there was obtained a continuity of fog-free images displaying a satisfactory half-tone (cf. curve-3 of the drawing). This fixed image was free from coming off even when rubbed with a finger.

What is claimed is:

1. A dry developing powder composition consisting essentially of a blend from 70 to 98 wt. % of Toner A particles and from 2 to 30 wt. % of Toner B particles, said Toner A particles having a mean grain size of from 10 to 30 microns and consisting essentially of a blend of (1) 20 to 80 parts by weight of wax or thermoplastic resin having a melting point of about 35° to 160° C., and (2) from 80 to 20 parts by weight of a pulverized magnetic substance having a mean grain size of from 0.1 to 2.5 microns, said Toner B particles having a mean grain size of from 5 to 20 microns and smaller than the mean grain size of said Toner A particles, said Toner B particles consisting essentially of (3) thermoplastic resin having a melting point of about 35° to 160° C., said Toner B being free of pulverized magnetic substance.

2. A dry developing powder composition according to claim 1, wherein Toner A additionally contains from 2 to 10 parts by weight of coloring agent per 100 parts by weight of the sum of said thermoplastic resin (1) and said pulverized magnetic substance (2).

3. A dry developing powder composition according to claim 1, wherein Toner A additionally contains from 2 to 20 parts by weight of filler per 100 parts by weight of the sum of said thermoplastic resin (1) and said pulverized magnetic substance (2), said filler being selected from the group consisting of calcium carbonate, magnesium oxide, talc, magnesium silicate, calcium silicate, magnesium carbonate and mixtures thereof.

4. A dry developing powder composition according to claim 1, wherein Toner B additionally contains from 2 to 10 parts by weight of coloring agent per 100 parts by weight of the sum of said thermoplastic resin (3).

5. A dry developing powder composition according to claim 1, wherein Toner B additionally contains from 2 to 20 parts by weight of filler per 100 parts by weight of the sum of said thermoplastic resin (3), said filler being selected from the group consisting of calcium carbonate, magnesium oxide, talc, magnesium silicate, calcium silicate, magnesium carbonate and mixtures thereof.

6. A dry developing powder composition according to claim 1, wherein Toner B additionally contains from 0.1 to 10 parts by weight of polarity-controlling agent per 100 parts by weight of the sum of said thermoplastic resin (3).

7. A dry developing powder composition consisting essentially of a blend of from 70 to 98 wt. % of Toner A particles and from 2 to 30 wt. % of Toner B particles, said Toner A particles having a mean grain size of from 10 to 30 microns and consisting essentially of a blend of (1) 20 to 80 parts by weight of wax or thermoplastic resin having a melting point of about 35° to 160° C., and (2) from 80 to 20 parts by weight of a pulverized magnetic substance having a mean grain size of from 0.1 to 2.5 microns, said Toner B particles having a mean grain size of from 5 to 20 microns and smaller than the mean grain size of said Toner A particles, said Toner B particles consisting essentially of a blend of (3) from 60 to 90 parts by weight of thermoplastic resin having a melting point of about 35° to 160° C. and (4) from 40 to 10 parts by weight of pulverized magnetic substance having a mean grain size of from 0.1 to 2.5 microns, the amount of said pulverized magnetic substance (4) in Toner B being less than the amount of pulverized magnetic substance (2) in Toner A.

8. A dry developing powder composition according to claim 7, wherein Toner B additionally contains from 2 to 10 parts by weight of coloring agent per 100 parts by weight of the sum of said thermoplastic resin (3) and said pulverized magnetic substance (4).

9. A dry developing powder composition according to claim 7, wherein Toner B additionally contains from 2 to 20 parts by weight of filler per 100 parts by weight of the sum of said thermoplastic resin (3) and said pulverized magnetic substance (4), said filler being selected from the group consisting of calcium carbonate, magnesium oxide, talc, magnesium silicate, calcium silicate, magnesium carbonate and mixtures thereof.

10. A dry developing powder composition according to claim 7, wherein Toner B additionally contains from 0.1 to 10 parts by weight of polarity-controlling agent per 100 parts by weight of the sum of said thermoplastic resin (3) and said pulverized magnetic substance (4).

11. A dry developing powder composition according to claim 7, wherein Toner A additionally contains from 2 to 10 parts by weight of coloring agent per 100 parts by weight of the sum of said thermoplastic resin (1) and said pulverized magnetic substance (2).

12. A dry developing powder composition according to claim 7, wherein Toner A additionally contains from 2 to 20 parts by weight of filler per 100 parts by weight of the sum of said thermoplastic resin (1) and said pulverized magnetic substance (2), said filler being selected from the group consisting of calcium carbonate, magnesium oxide, talc, magnesium silicate, calcium silicate, magnesium carbonate and mixtures thereof.

* * * * *